United States Patent [19]

Lorett

[11] Patent Number: 4,669,961

[45] Date of Patent: Jun. 2, 1987

[54] THRUST BALANCING DEVICE FOR A PROGRESSING CAVITY PUMP

[75] Inventor: Jerzy A. Lorett, Beaumaris, Australia

[73] Assignee: Hughes Tool Company, Houston, Tex.

[21] Appl. No.: 860,152

[22] Filed: May 6, 1986

[51] Int. Cl.[4] ..... F04C 2/107; F04C 15/00; F04B 47/14

[52] U.S. Cl. ..... 418/1; 418/48; 418/181; 417/365; 417/410; 415/104

[58] Field of Search ..... 418/1, 48, 71, 181, 418/270; 417/365, 410, 424; 415/104, 105

[56] References Cited

U.S. PATENT DOCUMENTS

| | | | |
|---|---|---|---|
| 2,692,507 | 10/1954 | Steensen | 418/182 |
| 2,737,119 | 3/1956 | Hill | 418/48 |
| 3,011,445 | 12/1961 | Bourke . | |
| 3,143,078 | 8/1964 | Gaslow et al. | 417/365 |
| 3,171,630 | 3/1965 | Harney et al. | 415/104 |
| 3,286,642 | 11/1966 | Lindberg . | |
| 3,583,205 | 6/1971 | Erle | 73/1 |
| 3,677,665 | 7/1972 | Corkill | 417/410 |
| 4,080,115 | 3/1978 | Sims et al. | 418/48 |
| 4,227,865 | 10/1980 | Erickson et al. | 417/365 |

*Primary Examiner*—John J. Vrablik
*Attorney, Agent, or Firm*—James E. Bradley

[57] ABSTRACT

A thrust reducing apparatus for a progressing cavity pump used in a well and driven by a submersible pump motor. A piston is mounted to the top of the rotor and located in a bore between the stator and the tubing which extends to the surface. A bypass passage enables fluid discharged from the pump to flow past the bore and the piston. An annulus passage extends into the bore above the piston for communicating fluid pressure in the annulus to the top of the piston. The lower side of the piston is exposed to discharge fluid pressure from the pump, resulting in a net upward force on the piston. The piston pulls upwardly on the rotor to reduce the downward thrust on the rotor.

4 Claims, 2 Drawing Figures

THRUST BALANCING DEVICE FOR A PROGRESSING CAVITY PUMP

BACKGROUND OF THE INVENTION

1. Field of the Invention

This invention relates in general to submersible well pumps, and in particular to a thrust balancing device for a progressing cavity pump rotated by a submersible pump motor.

2. Description of the Prior Art

Progressing cavity pumps, sometimes called "Moineau" pumps have been used for many years. These types of pumps have a stator and a rotor. The stator is an elastomer formed with an internal bore having a double helical configuration. The rotor has a single helical configuration, and is normally formed of metal. Rotating the rotor causes fluid to be pumped from one end of the stator to the other end.

These pumps have been used to some extent in oil field wells. Normally, the stator will be mounted to the lower end of the tubing, which is lowered into the well. The rotor is lowered on a string of sucker rod and inserted into the stator. The rod is rotated from the surface, normally by an electrical motor. Fluid is drawn in from the annulus in the casing into the lower end of the stator and pumped to the surface through the tubing.

There have been proposals to use a submersible motor to eliminate the need for rods extending to the surface. The motor will be located below the pump for rotating the rotor. One problem with a submersible pump motor system would be that there would be a great deal of thrust on the rotor in deep wells. The thrust is due to the pressure on the output end of the pump. The pressure would create a downward force on the rotor. Large thrust bearings would be needed to absorb the downward thrust. The size of the thrust bearing is necessarily limited by the small diameter of the pump.

SUMMARY OF THE INVENTION

The progressing cavity well pump of this system utilizes a downhole submersible pump motor. A thrust reducing apparatus is used to reduce the downward thrust on the rotor. The thrust reducing apparatus includes a piston which is mounted to the top of the rotor and located in a bore above the rotor and below the tubing, A bypass passage extends around the bore to the tubing for the discharge of fluid pumped from the pump. An annulus passage extends from the exterior to the top of the piston to apply annulus fluid pressure to the top of the piston.

The lower side of the piston is exposed to the discharge fluid pressure. The discharge fluid pressure is much greater than the annulus pressure, resulting in a net upward force. The upward force on the piston pulls upwardly on the rotor to reduce the downward thrust on the rotor.

DESCRIPTION OF THE PREFERRED EMBODIMENT

Figure 1:
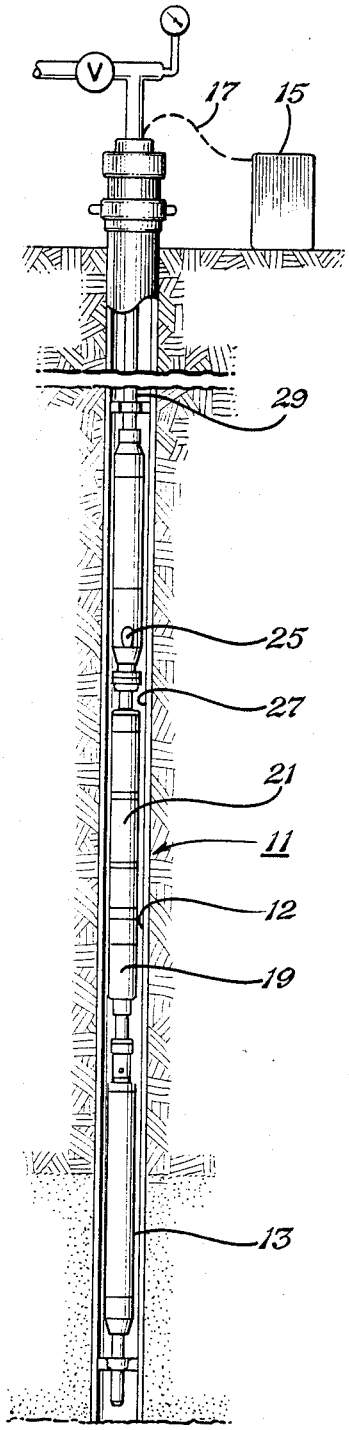
FIG. 1 is a schematic view showing a progressing cavity pump installed in a well and using a submersible pump motor.

Referring to FIG. 1, the progressing cavity pump installation is located in a well 11 which contains casing 12. An electrical motor 13 is located in the well. Electrical motor 13 is of a type used with submersible centrifugal pumps. Motor 13 is driven by alternating current supplied through power cable 17 by a power supply 15 located at the surface.

Motor 13 may have a gear box 19 on its upper end to reduce the speed of rotation. The shaft (not shown) from the gear box 19 extends through a seal section 21 for driving a progressing cavity pump 23. The seal section serves to seal lubricant in the gear box 19 and motor 13 from the well fluid. The seal section 21 also will reduce the pressure differential between the well fluid in casing 12 and the lubricant in the motor 13. Pump 23 has an intake 25 for drawing well fluid from the annulus 27 of the casing 12. Pump 23 pumps the fluid from the annulus 27 through tubing 29 to the surface.

Figure 2:
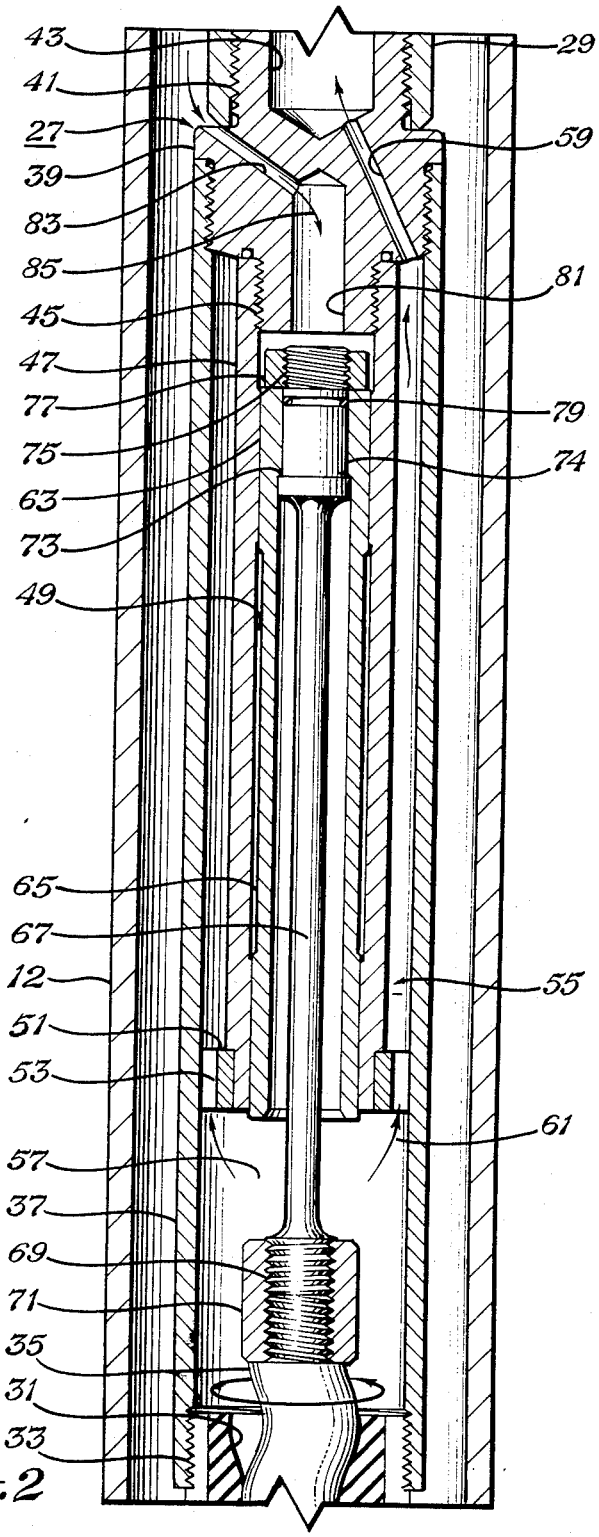
FIG. 2 is an enlarged sectional view of a thrust reducing apparatus for use with the system of FIG. 1.

Referring to FIG. 2, pump 23 has a stator 31 which is located inside a stator housing 33. Stator 31 is an elastomeric liner located in housing 33. Stator 31 has a double helical bore extending through it for receiving a rotary shaft or rotor 35. Rotor 35 is rotated by the drive shaft (not shown) of the motor 13. Rotor 35 has a single helical configuration, causing its ends to orbit or move in radial directions while rotated.

A housing 37 is secured to the upper end of the stator housing 33. Housing 37 includes an adapter head 39 screwed into its upper end. The adapter head 39 has an upper threaded end 4l that is screwed into the lower end of the tubing 29. The upper threaded end 41 has an upper cavity 43 that extends down into it and which communicates with the interior of the tubing 29.

The adapter head 39 also has a lower threaded end 45 that extends downwardly into the housing 37. A bushing or cylinder 47 is secured to the lower threaded end 45. Cylinder 47 extends downwardly in the housing 37 and contains a bore 49. The lower end of the cylinder 47 is supported concentrically in housing 37 by means of a centralizer 51. Centralizer 51 has holes 53 for fluid flow.

The outer diameter of cylinder 47 is smaller than the inner diameter of housing 37, defining an annular bypass clearance 55. The lower end of cylinder 47 terminates a selected distance above the upper end of the stator 31, resulting in a discharge chamber 57. The discharge chamber 57 communicates with bypass clearance 55. One or more bypass passages 59 extend through the adapter head 39 for communicating the bypass clearance 55 with the upper cavituy 43. As indicated by arrows 61, fluid discharged from the upper end of stator 31 flows from the discharge chamber 57 through the bypass clearance 55, through the bypass passage 59, through the upper cavity 43 and upwardly through the tubing 29.

A piston 63 is sealingly and rotatably carried inside the bore 49 of cylinder 47. Piston 63 is a tubular member having a cylindrical exterior that is slidingly and sealingly received in bore 49. Annular recesses 65 are located in the central section of both the bore 49 and piston 63. The recesses 65 reduce the contact surface between the piston 63 and the bore 49 and so reduce the friction losses.

Piston 63 includes a rod 67 that has a threaded lower end 69. The threaded lower end 69 is secured into a coupling 71 formed on the upper end of the rotor 35. Rod 67 extends upwardly into the interior of piston 63. Rod 67 has a shoulder 73 that bears against a shoulder formed in the interior of the piston 63. Shoulder 73 forms the lower end of an enlarged diameter head 74 that is sealingly received in the interior of the piston 63. Head 74 has a threaded upper end 75 that extends through the upper end of piston 63. A nut 77 is used to tighten the threaded upper end 75 to the piston 63, pulling the shoulder 73 tightly against the shoulder formed inside the piston 63. A seal 79 located on the head 74 seals the interior of the piston 63.

The threaded upper end 75 of rod 67 is spaced a short distance below the lower threaded end 45 of the adapter head 39. A lower cavity 81 is formed in the lower threaded end 45. A passage 83 extends from the lower cavity 81 to the exterior of the adapter head 39. Passage 83 is referred to herein as annulus passage 83. As indicated by arrows 85, annulus passage 83 allows well fluid in the annulus 27 of casing 12 to communicate with lower cavity 81 and to act against the upper end of the piston 63.

In operation, the motor 13 will be supplied with electrical power through the power cable 17 from the power supply 15, causing rotor 35 to rotate. This rotation causes the upper end at coupling 71 to orbit. That is, not only will it rotate, it will move radially back and forth as it rotates. The head 74 of rod 67 is rigidly mounted to the top of the piston 63 and thus cannot move radially as does its lower end 69. The elongated rod 67 flexes along its length to accommodate the orbiting movement of lower end 69.

The rotation of the rotor 35 causes fluid to be drawn into the intake 25 and pumped out the discharge chamber 57. The well fluid flows through the holes 53, bypass clearance 55, bypass passage 59, upper cavity 43, and into the tubing 29, where it proceeds to the surface.

Because of the open lower end of the bore 49, the discharge fluid pressure is also communicated to the piston 63. The pressure of the well fluid in the annulus 27 is communicated to the top of the piston 63 by means of the annulus passage 83 and the lower cavity 81. A downward force is exerted by the annulus fluid pressure on the piston 63, but this force is normally very small because the level of the annulus fluid will not be very far above pump 23. An upward force is exerted by the discharge fluid pressure on the piston 63. The piston 63 has the same diameter on its lower end as it does on its upper end. However, the net force will be upward, because the discharge fluid pressure will be much greater than the annulus fluid pressure. The net upward force on the piston 63 pulls upwardly on the rod 67, and thus pulls upwardly on the rotor 35.

At the same time, there is a downward force on the rotor 35 due to the pressure in the discharge chamber 57. The downward force acting on rotor 35 is reduced by the amount of the upward force acting on the piston 63. Because of the low pressure exerted by the fluid in annulus 27 relative to the pressures exerted on piston 63 by the pump pressure, the upward and downward forces on rotor 35 will substantially equal each other. Piston 63 is free to move upwardly and downwardly slight amounts in bore 49 to balance the thrust on rotor 35.

The clearance between the rod 67 and the inner wall of the piston 63 allows some translational movement of the rod 67 as it flexes. Preferably, the diameter of rod 67 is determined by the thrust load upon the piston 63 and is usually less than one-half that of the piston 63. The length of the rod 67 is determined by the required radial flexibility and is usually at least ten times its diameter.

The invention has significant advantages. The thrust reducing device reduces the amount of downward thrust on the rotor. This reduces the load requirements for the thrust bearings located at the lower end of the rotor. The thrust chamber is simple in construction, and accommodates the orbiting movement of the rotor.

While the invention has been shown in only one of its forms, it should be apparent to those skilled in the art that it is not so limited, but is susceptible to various changes without departing from the scope of the invention.

I claim:

1. For use with a well pump having a rotary shaft located in a housing and rotated by a downhole motor located below the rotary shaft for pumping fluid from the well annulus to the surface through tubing mounted above the housing, a thrust reducing apparatus, comprising:

a piston mounted to the top of the rotary shaft and located in a bore;

bypass passage means extending past the bore to the tubing for discharging fluid to the tubing that is pumped by the pump;

annulus passage means extending from the annulus to the bore above the piston, for communicating fluid in the annulus to the top of the piston; and the lower side of the piston being exposed to the discharge fluid pumped by the pump, to apply discharge fluid pressure to the lower side of the piston, and create an upward force on the rotary shaft to counteract downward thrust on the rotary shaft.

2. In combination with a well pump having a rotary shaft located in a housing and rotated by a downhole motor located below the rotary shaft for pumping fluid from the well annulus to the surface through tubing mounted above the housing, a thrust reducing apparatus, comprising:

a bore located in housing, having its lower end exposed to discharge fluid pressure from the pump;

bypass passage means in the housing, extending past the bore for the passage to the tubing of discharge fluid from the pump;

a piston mounted to the top of the rotary shaft for rotation therewith and sealingly and rotatably carried inside the bore, with the lower side of the piston being exposed to the discharge fluid pressure from the pump; and annulus passage means extending through the housing to the bore above the piston for communicating annulus fluid pressure to the upper side of the piston, the annulus fluid pressure being less than the discharge fluid pressure to result in an upward force on the piston, which pulls upwardly on the rotary shaft to reduce net downward thrust on the rotary shaft.

3. A progressing cavity well pump installation for pumping fluid from a well annulus through tubing to the surface, comprising in combination:

a stator;

a housing mounted below the stator in the tubing;

a helical rotor rotatably carried in the stator;

a motor mounted to the lower end of the rotor for rotating the rotor;

a bore located in the housing having its lower end exposed to discharge fluid pressure from the pump;

bypass passage means in the housing, extending past the bore for the passage to the tubing of the discharge fluid from the pump;

a piston sealingly and rotatably carried in the bore, the piston having a hollow interior;

a rod having its lower end rigidly mounted to the top of the rotor for movement therewith, the rod extending upwardly into the hollow interior of the piston, and secured to the piston for movement therewith adjacent the top of the piston, the length and diameter of the rod allowing flexing of the rod due to orbiting movement of the upper end of the rotor; and annulus passage means extending through the housing to the bore above the piston for communicating annulus fluid pressure to the upper side of the piston, the annulus fluid pressure being less than the discharge fluid pressure to result in an upward force on the piston, which acting through the rod pulls upwardly on the rotor to reduce the net downward thrust on the rotor.

4. A method of reducing thrust on the rotary shaft of a pump located in a well and being of the type having a rotary shaft located in a housing and rotated by a downhole motor below the rotary shaft for pumping fluid from the well annulus to the surface through tubing mounted above the housing, the method comprising:

mounting a piston to the top of the rotary shaft and locating it in a bore below the tubing;

providing a bypass passage for discharging fluid from the pump to bypass the bore and flow into the tubing;

communicating annulus well fluid pressure to the top of the piston; and communicating discharge fluid pressure to the bottom of the piston, to provide a net upward force on the piston for pulling upwardly on the rotary shaft to reduce downward thrust on the rotary shaft.

* * * * *